US006234096B1

(12) United States Patent
Suh

(10) Patent No.: US 6,234,096 B1
(45) Date of Patent: May 22, 2001

(54) BUTTON FEEDING DEVICE WITH BOTH WIDTH CONTROL FUNCTION AND CENTERING FUNCTION

(76) Inventor: Myung Won Suh, 425-5, Han Yang 203, Sin Wol-dong, Yang Chun-gu, Seoul 158-094 (KR)

( * ) Notice: Subject to any disclaimer, the term of this patent is extended or adjusted under 35 U.S.C. 154(b) by 0 days.

(21) Appl. No.: 09/555,049

(22) PCT Filed: Nov. 23, 1998

(86) PCT No.: PCT/KR98/00373

§ 371 Date: May 24, 2000

§ 102(e) Date: May 24, 2000

(87) PCT Pub. No.: WO99/27174

PCT Pub. Date: Jun. 3, 1999

(30) Foreign Application Priority Data

Nov. 24, 1997 (KR) ..... 97-62285

(51) Int. Cl.[7] ..... D05B 3/22
(52) U.S. Cl. ..... 112/113; 112/110
(58) Field of Search ..... 112/104, 105, 112/106, 108, 110, 113, 114, 115, 304, 306

(56) References Cited

U.S. PATENT DOCUMENTS

| | | | | |
|---|---|---|---|---|
| 3,123,251 | * | 3/1964 | Schneider, Jr. | 112/113 |
| 3,363,805 | * | 1/1968 | Prezes | 112/113 X |
| 3,633,524 | | 1/1972 | Hoffsommer et al. . | |
| 4,069,777 | | 1/1978 | Ishikawa . | |
| 4,334,486 | | 6/1982 | Toshiaki et al. . | |
| 4,373,459 | | 2/1983 | Dunn et al. . | |
| 4,389,953 | | 6/1983 | Bergvall . | |
| 4,512,271 | | 4/1985 | Herdeg et al. . | |
| 4,607,585 | | 8/1986 | Meier . | |
| 4,714,034 | * | 12/1987 | Riss et al. | 112/113 |
| 4,717,061 | * | 1/1988 | Seki | 112/113 X |
| 5,035,192 | * | 7/1991 | Nirenberg et al. | 112/113 X |

FOREIGN PATENT DOCUMENTS 25 17 339 10/1976 (DE) .

* cited by examiner

*Primary Examiner*—Ismael Izaguirre
(74) *Attorney, Agent, or Firm*—McDermott, Will & Emery

(57) ABSTRACT

A device for feeding buttons to a sewing position. The device centers the buttons and adjusts the width and height of a button feeding passage in accordance with the dimension of the buttons to be conveyed by a conveyor belt, thus appropriately arranging the buttons on garments at the sewing position. The device has two movable guide beds defining a button guide channel. A height adjusting unit is provided above the button guide channel and is vertically moved relative to the channel in accordance with the dimension of the buttons, thus adjusting the height of the channel. A width adjusting unit is operated in conjunction with the two guide beds so as to adjust the width of the channel in accordance with a width of the buttons. A centering unit is operated in conjunction with the width adjusting unit so as to center each of the conveyed buttons at an outlet of the channel. A rotatable feeding unit is arranged to be rotatable between the outlet of the channel and the sewing position, thus feeding the centered buttons from the outlet of the channel to the sewing position.

5 Claims, 6 Drawing Sheets

BUTTON FEEDING DEVICE WITH BOTH WIDTH CONTROL FUNCTION AND CENTERING FUNCTION

BACKGROUND OF THE INVENTION

1. Field of the Invention

The present invention relates, in general, to a device for feeding buttons to a sewing position using a conveyor belt and, more particularly, to a device for feeding buttons to a sewing position while centering the buttons and adjusting the width and height of a button feeding passage in accordance with the dimension of the buttons to be conveyed by the conveyor belt, thus appropriately arranging the buttons on garments at the sewing position.

2. Description of the Prior Art

As well known to those skilled in the art, buttons are originally used to fasten a shirt, coat, etc. and particularly have a collateral function to decorate the clothes when they are sewn on outerwear.

Such buttons are put on during a process of manufacturing clothes. The buttons are typically made of hard materials and have two or more holes at which the buttons are sewn on garments. When the buttons are manually sewn on garments, the buttons have to be manually positioned at the sewing position one by one and this reduces work efficiency of the sewing operation. On the other hand, when the buttons are automatically sewn on garments, the buttons have to be fed to the sewing position by a feeding member. However, it is necessary to prepare a plurality of feeding members having different dimensions meeting different sizes of buttons to be fed to the sewing position. During a sewing process, the feeding members have to be changed in accordance with the sizes of buttons to be fed to the sewing position. This reduces work efficiency and productivity of the sewing process.

In addition, there is no means for centering the buttons at the sewing position. Therefore, the button feeding operation may fail to accomplish the desired work efficiency. Particularly, when the buttons are fed to the sewing position with the buttons being not centered, this causes the buttons to be badly sewn on the garments at the sewing position.

SUMMARY OF THE INVENTION

Accordingly, the present invention has been made keeping in mind the above problems occurring in the prior art, and an object of the present invention is to provide a device for feeding buttons to a sewing position while centering the buttons and adjusting the width and height of a button feeding passage in accordance with the dimension of the buttons to be conveyed by a conveyor belt, thus appropriately arranging the buttons on garments at the sewing position.

In order to accomplish the above object, the present invention provides a device for automatically feeding a plurality of buttons to a sewing position using a conveyor belt, comprising: first and second movable guide beds axially arranged along both sides of the conveyor belt, thus defining an elongated button guide channel at a position between them and above the conveyor belt with both a height and a width of the channel being adjustable in accordance with a dimension of buttons to be fed to the sewing position; a height adjusting unit provided above the button guide channel and designed to be vertically movable relative to the channel in accordance with the dimension of the buttons, thus adjusting the height of the channel so as to allow the buttons to be stably conveyed without being movable in a vertical direction on the conveyor belt; a width adjusting unit operated in conjunction with the two guide beds so as to selectively and laterally move the two guide beds in opposite directions, thus adjusting the width of the channel in accordance with a width of the buttons and allowing the buttons to be stably conveyed without being movable from side to side on the conveyor belt; a centering unit operated in conjunction with the width adjusting unit so as to center each of the conveyed buttons at an outlet of the channel; and a rotatable feeding unit arranged to be rotatable between the outlet of the channel and the sewing position, thus feeding each of the centered buttons from the outlet of the channel to the sewing position while retaining the centered position of the buttons.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
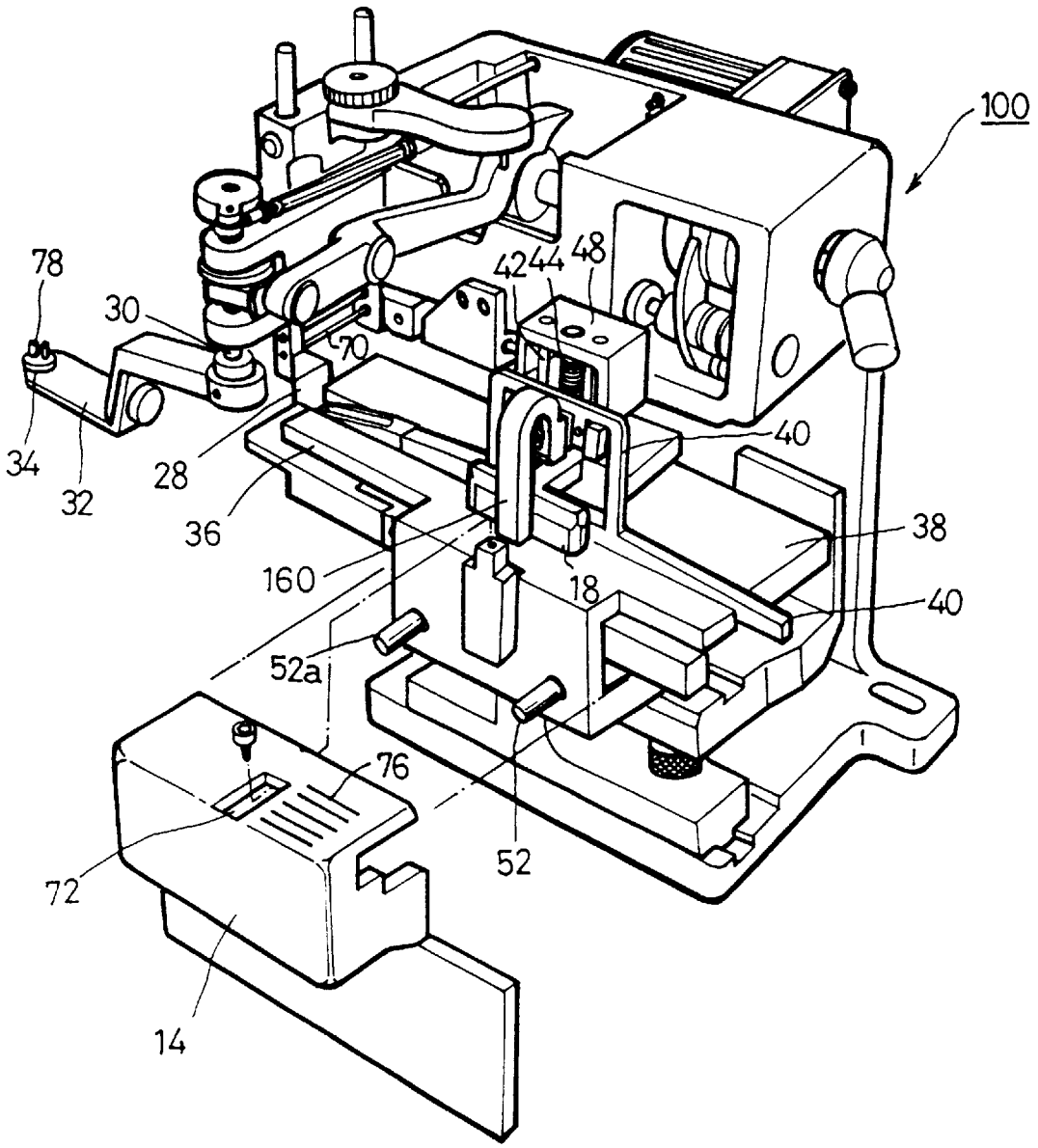
FIG. 1 is a perspective view, showing the construction of a button feeding device in accordance with the preferred embodiment of the present invention.
Figure 2:
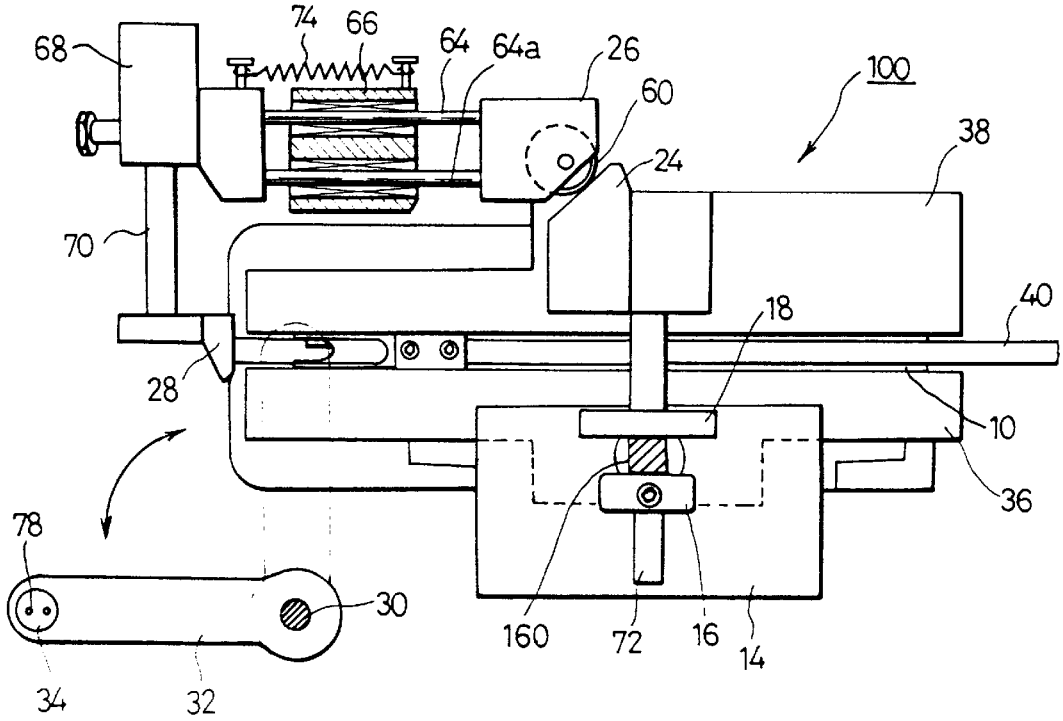
FIG. 2 is a plan view of the button feeding device of this invention, with the device being partially-sectioned at a height.
Figure 3:
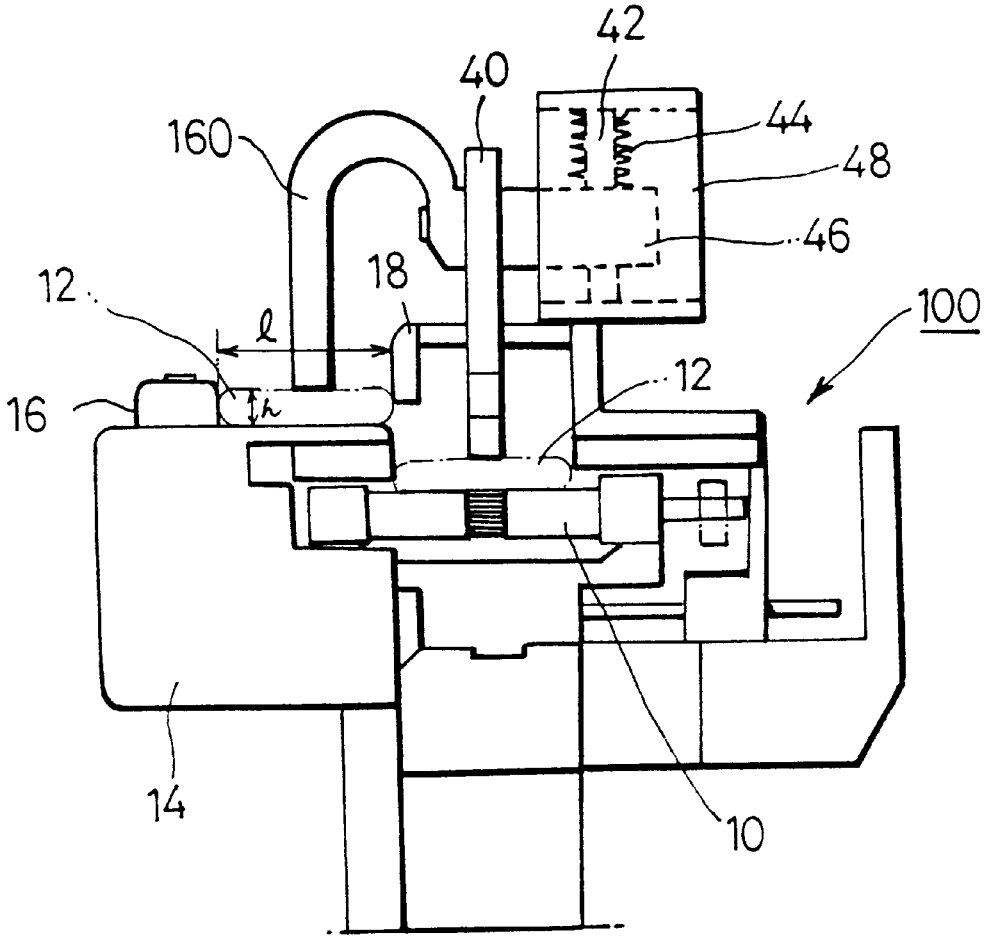
FIG. 3 is a side view of the button feeding device of this invention.
Figure 4:
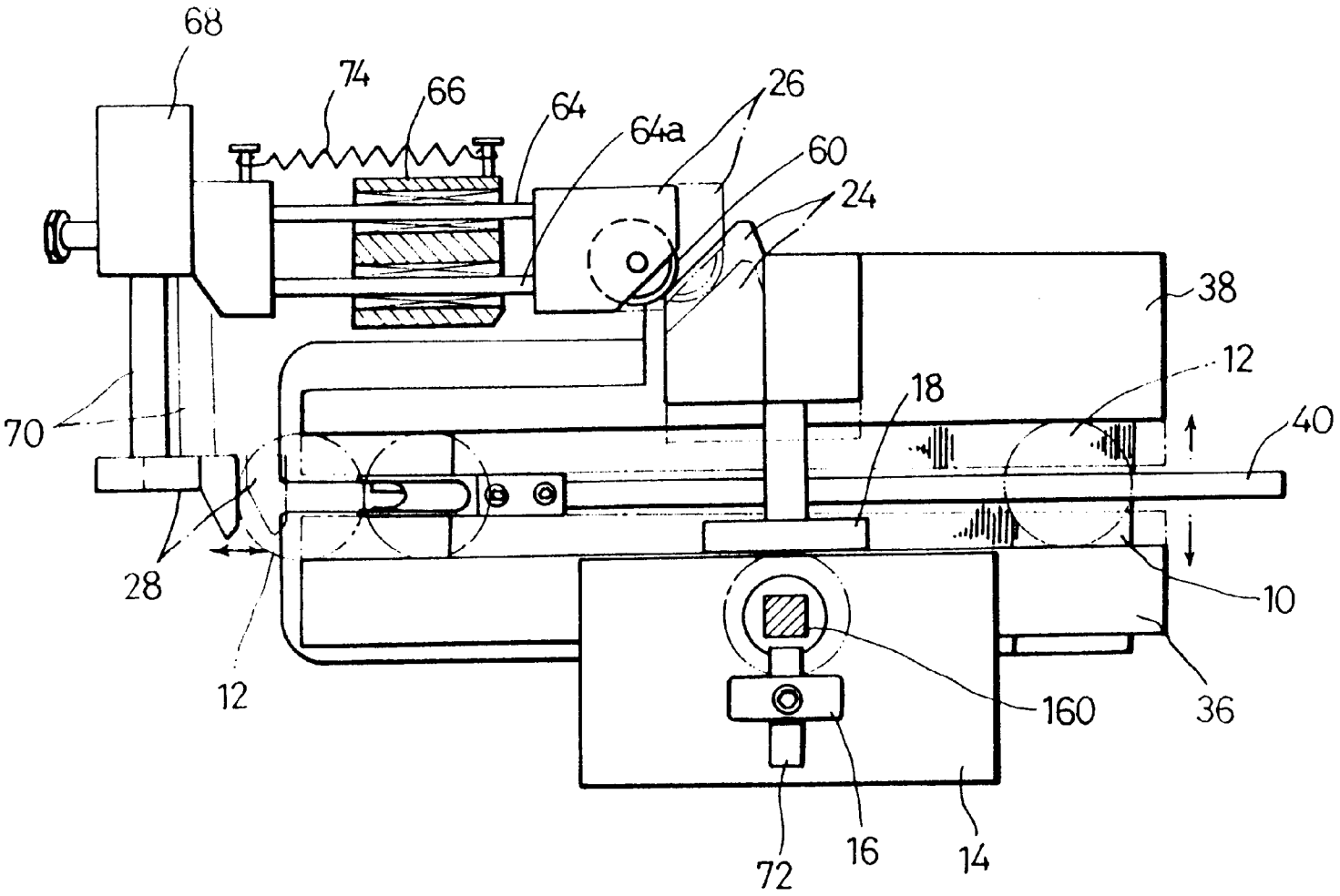
FIG. 4 is a plan view, showing an operation of the button feeding device of this invention, with the device being partially-sectioned at a height.
Figure 5:
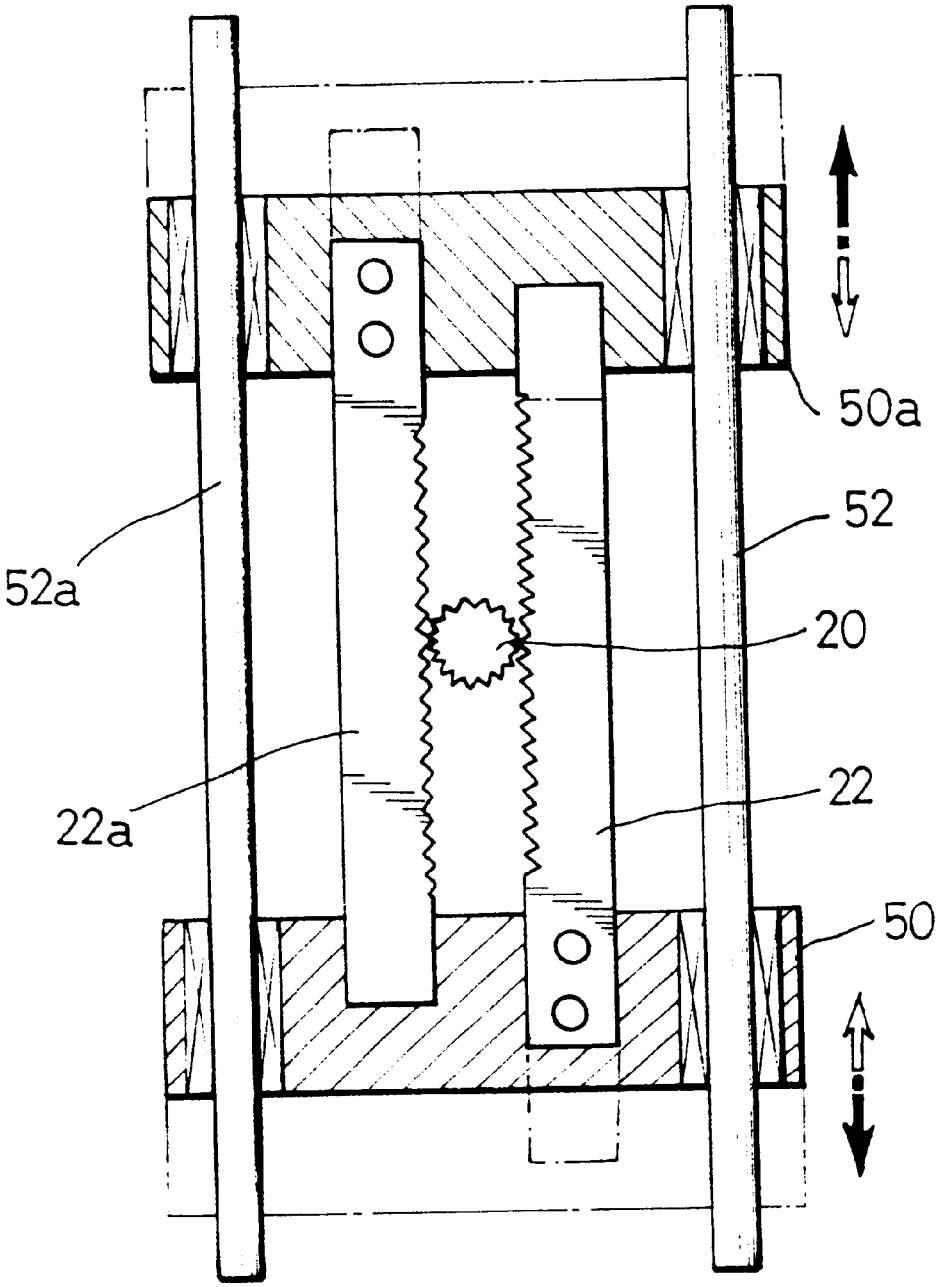
FIG. 5 is a sectional view of a width adjusting unit included in the device of this invention.

FIG. 1 is a perspective view, showing the construction of a button feeding device in accordance with the preferred embodiment of this invention. FIG. 2 is a plan view of the above button feeding device, with the device being partially-sectioned at a height. FIG. 3 is a side view of the above button feeding device. As shown in the drawings, the button feeding device 100 of this invention is used for automatically feeding a plurality of buttons 12*a* to a sewing position using a conveyor belt 10. The conveyor belt 10 is arranged along the axis of the device 100.

The above device 100 comprises first and second movable guide beds 36 and 38. The two guide beds 36 and 38 are axially arranged along both sides of the conveyor belt 10, thus defining an elongated button guide channel along and above the conveyor belt 10. In accordance with the present invention, both the height and the width of the channel are adjustable in accordance with a dimension of the buttons 12*a* to be fed to the sewing position. The two guide beds 36 and 38 are designed to be laterally movable in opposite directions, thus being closer to or remote from each other as will be described later herein.

A height adjusting unit is provided above the button guide channel and is designed to be vertically movable relative to the channel in accordance with the dimension or the thickness "h" and the width "l" of the buttons 12*a*, thus adjusting the height of the channel so as to allow the buttons 12*a* to be stably conveyed without being movable in a vertical direction on the conveyor belt 10.

In the height adjusting unit, a liftable height adjuster 160 is arranged above a fixed button base 14 and is normally biased downwardly. The above height adjuster 160 thus selectively comes into contact with the top surface of a sample button 12 which is placed on the base 14, thus raising the height adjusting unit to a height corresponding to the thickness of the sample button 12. An elongated top guider 40 integrally intersects to the rear portion of the height adjuster 160 at right angles and is arranged along and above the channel. The top guider 40 is thus vertically movable along with the height adjuster 160 so as to limit the height of the channel in accordance with the thickness of the sample button 12. The top guider 40 guides the top surfaces of the buttons 12*a* fed by the conveyor belt 10. A guide block 46 is integrated with the height adjuster 160 at a position behind the top guider 40 and is movably fitted over two vertically extending, fixed guide rods 42. The two guide rods 42 are fixedly and vertically set in a housing 48 with a spring 44 normally biasing the guide block 46 downwardly. Therefore, the liftable height adjuster 160 is always positioned on the center of the sample button 12 laid on the base 14, while the top guider 40 is positioned above and along the central axis of the channel.

The device also includes a width adjusting unit, which is operated in conjunction with the two guide beds 36 and 38 so as to selectively and laterally move the two guide beds 36 and 38 in opposite directions. The width of the channel is thus adjusted in accordance with the width of the buttons 12*a* and allows the buttons 12*a* to be stably conveyed without being movable from side to side on the conveyor belt 10.

In the above width adjusting unit, first and second width measuring jaws 16 and 18 are movably positioned above the fixed button base 14 so as to be selectively opened or closed to measure the width of the sample button 12 placed on said base 14. The two jaws 16 and 18 are respectively integrated with the first and second guide beds 36 and 38, thus selectively and laterally moving the two guide beds 36 and 38 and thereby adjusting the width of the channel in accordance with the width of the sample button 12 laid on the base 14. The above width adjusting unit also has two guide brackets 50 and 50*a*. The two guide brackets 50 and 50*a* are respectively positioned under the two guide beds 36 and 38 and are integrated with said beds 36 and 38. First and second parallel racks 22 and 22*a* are respectively integrated with the two guide brackets 50 and 50*a* in a way such that the two brackets 50 and 50*a* are oppositely positioned. The above racks 22 and 22*a* engage with diametrically opposite portions of a pinion gear 20, thus allowing the two guide brackets 50 and 50*a* along with the two guide beds 36 and 36*a* to be movable closer to or remote from each other in accordance with a movement of the first measuring jaw 16. Two fixed, parallel guide bars 52 and 52*a* extend along the two racks 52 and 52*a* and pass through the two guide brackets 50 and 50*a*, thus guiding an opposite directional linear movement of the two guide brackets 50 and 50*a*.

The fixed base 14 has a longitudinal slit 72 which allows the bolt of the first jaw 16 to pass through, thus guiding a lateral movement of the first jaw 16.

The device 100 also has a centering unit which is operated in conjunction with the width adjusting unit so as to center each of the conveyed buttons 12*a* at the outlet of the channel. In addition, a rotatable feeding unit is arranged to be rotatable between the outlet of the channel and the sewing position, thus feeding each of the centered buttons 12*a* from the outlet of the channel to the sewing position while retaining the centered position of the buttons 12*a*.

The above centering unit comprises a drive guider 24, which is integrated with the second measuring jaw 18, thus being laterally movable in conjunction with the second measuring jaw 18 in the same direction. A corner of the drive guider 24 is chamfered at an angle. A driven guider 26 is arranged to be movable in an axial direction relative the channel and is actuated by the drive guider 24. The driven guider 26 is provided with a roller 60 at one corner thereof and is brought into contact with the chamfered corner of the drive guider 24 at said roller 60. Two parallel guide shafts 64 and 64*a* integrally extend from the driven guider 26 in the same direction as a moving direction of the driven guider 26. The two guide shafts 64 and 64*a* slidably pass through a fixed guide member 66, thus being linearly movable along with the driven guider 26 in the axial direction under the guide of the fixed guide member 66. Fixed to the two guide shafts 64 and 64*a* at a position opposite to the driven guider 26 is an air cylinder 68. A retractable connection rod 70 extends from the air cylinder 68 in a direction toward the outlet of the channel and is actuated by the air cylinder 68 so as to selectively reach the outlet of the channel when being fully extended. Fixed to the outside end of the connection rod 70 is a centering stopper 28. The centering stopper 28 is adapted for stopping each of the conveyed buttons 12*a* at the outlet of the channel while centering the buttons 12*a*.

The above air cylinder 68 is normally biased toward the fixed guide member 66 by an extension coil spring 74, thus being automatically returned to its original position when an external force is removed from the air cylinder 68.

In the rotatable feeding unit, a shafted arm 32 is arranged to be rotatable around a shaft 30 at an angle, thus selectively reaching the outlet of the channel or the sewing position. The above arm 32 is provided with a button holder 34 at its free end for retaining the centered position of the buttons 12*a* while moving each of the centered buttons 12*a* from the outlet of the channel to the sewing position.

In the drawings, the reference numeral 76 denotes a position mark provided on the fixed button base 14 for allowing a sample button 12 to be precisely placed on the base 14. The numeral 78 denotes two pins, which are provided on the button holder 34 for retaining the centered position of the buttons 12*a* while moving each of the centered buttons 12*a* from the outlet of the channel to the sewing position.

The above device is operated as follows. After selecting buttons 12*a* to be sewn on a garment at the sewing position, a sample or one of the selected buttons 12*a* is placed on the position mark 76 of the fixed button base 14. In such a case, the height adjuster 160 is primarily ascended. Thereafter, the first and second measuring jaws 16 and 18 are moved in opposite directions so as to receive the sample button 12 on the position mark 76. That is, the positions of the two jaws 16 and 18 are appropriately adjusted in a way such that the two jaws 16 and 18 are brought into contact with diametrically opposite portions of the sample button 12, respectively. Thereafter, the height adjuster 160 is descended to come into contact with the top center of the sample button 12 laid on the base 14. In such a case, the height adjuster 160 precisely comes into contact with the top center of the sample button 12 laid on the base 14 regardless of the diameter of the sample button 12, while the top guider 40 is positioned above and along the central axis of the channel. The width and thickness of the button feeding channel are thus automatically adjusted.

After adjusting the width and thickness of the channel, a plurality of selected buttons 12*a* are orderly and slowly raised from a vibrator (not shown) so as to be fed onto the inlet end of the conveyor belt 10. Thereafter, the buttons 12*a* are slowly and linearly moved from right to left in the drawings by the conveyor belt 10 under the guide of the first and second guide beds 36 and 38. At the left end of the device 100, each of the buttons 12*a* is stopped by the centering stopper 28 while being automatically centered. The buttons 12*a* are, thereafter, fed to a sewing position by the rotatable feeding unit.

In a detailed description, the first jaw 16 of the first guide bed 36 is integrated with the first guide bracket 50, which is positioned under the top surface of the first guide bed 36. The first guide bracket 50 is integrated with one end of the first rack 22. The above first rack 22 engages with the pinion gear 20, thus being linearly movable in conjunction with said pinion gear 20. In addition, the two parallel guide bars 52 and 52*a* movably pass through the first guide bracket 50, thus guiding a linear movement of said guide bracket 50. On the other hand, the second jaw 18 of the second guide bed 38 is integrated with the second guide bracket 50*a*, which is positioned under the top surface of the second guide bed 38. The second guide bracket 50*a* is integrated with one end of the second rack 22*a* at a position opposite to the first guide bracket 50. The above second rack 22*a* engages with the above pinion gear 20 at a position diametrically opposite to the first rack 22. That is, the first and second racks 22 and 22*a* commonly engage with the pinion gear 20 at diametrically opposite portions and extend in parallel to each other. Therefore, when the first jaw 16 is moved in a direction allowing the gap between the two jaws 16 and 18 to be enlarged, the first guide bracket 50, along with the first rack 22, is moved in the same direction under the guide of the two guide bars 52 and 52*a*. The pinion gear 20 is thus rotated clockwise. Such a clockwise rotating action of the pinion gear 20 causes the second rack 22*a* to be moved in an opposite direction under the guide of the two guide bars 52 and 52*a*, and so the brackets 50 and 50*a* are moved away from each other at the same time. Since the two guide brackets 50 and 50*a* are integrated with the first and second guide beds 36 and 38, respectively, they thus move the two beds 36 and 38 in opposite directions. Therefore, the two guide beds 36 and 38 are moved to be away from or close to each other. The width of the channel defined between the two beds 36 and 38 is thus adjusted to meet the width of the selected buttons 12*a* which are linearly fed by the conveyor belt 10.

When the second jaw 18 is moved in a direction as described above, the drive guider 24, integrated with the second jaw 18, is moved in the same direction, thus moving the driven guider 26 in a direction perpendicular to the moving direction of the drive guider 24. In the present invention, it is preferable to chamfer the junction corners of the two guiders 24 and 26 at an angle, thus allowing the driven guider 26 to be precisely movable in a direction perpendicular to the moving direction of the drive guider 24. It is most preferable to chamfer the junction corners of the two guiders 24 and 26 at an angle of 45°.

The roller 60 is set at the chamfered corner of the driven guider 26, thus being brought into contact with the chamfered corner of the drive guider 24. Therefore, when the drive guider 24 is moved in a direction, the driven guider 26 is moved in a direction perpendicular to the moving direction of the drive guider 24 with the roller 60 being rolled on the chamfered corner of the drive guider 24. The two guide shafts 64 and 64*a* integrally and parallely extend from the guider 26 in the same direction as the moving direction of the guider 26. The two guide shafts 64 and 64*a* commonly and movably pass through the fixed guide member 66 prior to being integrated with the air cylinder 68, thus being movable under the guide of the fixed guide member 66. The air cylinder 68 is thus movable in the same direction as the moving direction of the driven guider 26. The rod 70 integrally extends from the air cylinder 68 to a length, with the centering stopper 28 being fixed to the outside end of the rod 70 and reaching the outlet of the channel of said two guide beds 36 and 38. The centering stopper 28 is thus movable along with the air cylinder 68 so as to automatically center the buttons 12*a* at the outlet of the channel. The air cylinder 68 is also coupled to the fixed guide member 66 through a tension coil spring 74. Therefore, when an external force is removed from the air cylinder 68 after pushing the air cylinder 69 away from the fixed guide member 66, the extension coil spring 74 automatically returns the air cylinder 68 to its original position due to its restoring force.

Figure 6:
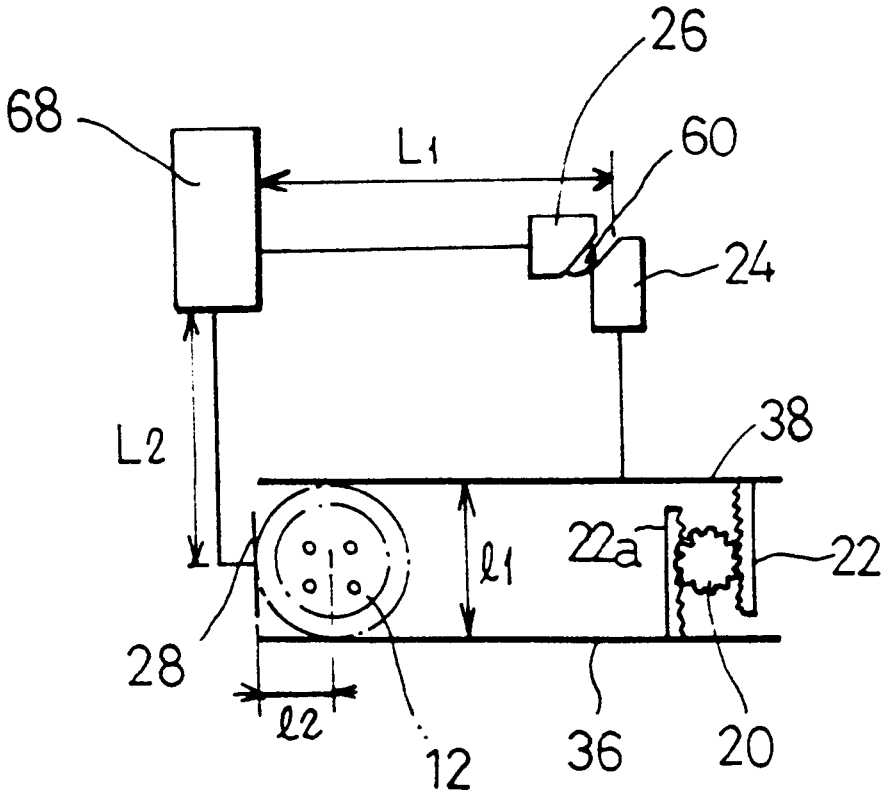
FIG. 6 is a schematic view, showing the operational theory of the button feeding device of this invention.

The above centering stopper 28, positioned around the outlet of the channel of said two guide beds 36 and 38, is movable in opposite directions to be away from or close to the outlet of said channel. In such a case, the moving distance of the centering stopper 28 is l2 which is half of the width l1 between the two guide beds 36 and 38 as best seen in FIG. 6. Therefore, the centering stopper 28 precisely centers the buttons 12*a* at the outlet of the channel of the two guide beds 36 and 38.

In addition, the distance L1 from the drive guider 24 to the air cylinder 68 is variable in accordance with a movement of the guider 24, while the distance L2 between the air cylinder 68 and the centering stopper 28 is fixed.

Therefore, after setting the buttons 12*a* on the center of the button holder 34 by the centering stopper 28, the rod 70 is retracted by the air cylinder 68, thus allowing the centering stopper 28 to be moved away from the button 12. Thereafter, the rotating shaft 30 is lifted prior to being rotated, thus rotating the arm 32 from the outlet of the channel to a position where the button 12*a* is sewn on a garment. In such a case, the button 12*a* is held by the holding pins 78 of the button holder 34 and so the centered button 12*a* is not unexpectedly removed from the button holder 34.

After feeding the centered button 12*a* to the sewing position, the button holder 34 is returned to its original position around the outlet of the channel of the two guide beds 36 and 38. Thereafter, the rod 70 advances to the position around the outlet of said channel by the air cylinder 68 to repeat the above-mentioned button feeding process.

As described above, the present invention provides a device for feeding buttons to a sewing position. The device precisely centers the buttons and adjusts the width and height of a button feeding passage in accordance with the dimension of the buttons to be conveyed by a conveyor belt, thus appropriately arranging the buttons on garments at the sewing position. The device thus improves the work efficiency and productivity of the sewing operation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A device for automatically feeding a plurality of buttons to a sewing position using a conveyor belt, comprising:

first and second movable guide beds axially arranged along both sides of said conveyor belt, thus defining an elongated button guide channel at a position between them and above said conveyor belt with both a height and a width of said channel being adjustable in accordance with a dimension of buttons to be fed to said sewing position;

a height adjusting unit provided above said button guide channel and designed to be vertically movable relative to the channel in accordance with the dimension of said buttons, thus adjusting the height of said channel so as to allow the buttons to be stably conveyed without being movable in a vertical direction on said conveyor belt;

a width adjusting unit operated in conjunction with said two guide beds so as to selectively and laterally move the two guide beds in opposite directions, thus adjusting the width of said channel in accordance with a width of the buttons and allowing the buttons to be stably conveyed without being movable from side to side on said conveyor belt;

a centering unit operated in conjunction with said width adjusting unit so as to center each of the conveyed buttons at an outlet of said channel; and a rotatable feeding unit arranged to be rotatable between the outlet of the channel and the sewing position, thus feeding each of the centered buttons from the outlet of the channel to the sewing position while retaining the centered position of said buttons.

2. The device according to claim 1, wherein said height adjusting unit comprises:

a liftable height adjuster arranged above a fixed button base and normally biased downwardly, and adapted for selectively coming into contact with a top surface of a sample button placed on said base, thus raising the height adjusting unit to a height corresponding to a thickness of said sample button;

an elongated top guider integrally intersecting to a rear portion of said height adjuster at right angles and arranged along and above said channel, said top guider being vertically movable along with the height adjuster so as to limit the height of the channel in accordance with the thickness of the sample button and guide the top surfaces of the conveyed buttons; and a guide block integrated with said height adjuster at a position behind said top guider and movably fitted over two vertically extending, fixed guide rods with a spring normally biasing the guide block downwardly, said two guide rods being fixedly and vertically set in a housing, thus allowing both the liftable height adjuster to be positioned on a center of the sample button and the top guider to be positioned above and along a central axis of the channel.

3. The device according to claim 1, wherein said width adjusting unit comprises:

first and second width measuring jaws movably positioned above said fixed button base so as to be selectively opened or closed to measure the width of the sample button placed on said base, said jaws being respectively integrated with said first and second guide beds, thus selectively and laterally moving the two guide beds and thereby adjusting the width of the channel in accordance with the width of the sample button;

first and second guide brackets respectively positioned under and integrated with the first and second guide beds;

first and second parallel racks respectively integrated with said first and second guide brackets in a way such that the two guide brackets are oppositely positioned, said racks engaging with diametrically opposite portions of a pinion gear, thus allowing the two guide brackets along with the two guide beds to be movable closer to or remote from each other at the same time in accordance with a movement of either one of the two measuring jaws; and two fixed, parallel guide bars extending along the two racks and passing through the first and second guide brackets, thus guiding an opposite directional linear movement of the two guide brackets.

4. The device according to claim 1, wherein said centering unit comprises:

a drive guider integrated with the second measuring jaw, thus being laterally movable in conjunction with the second measuring jaw in the same direction, with a corner of said feeding guider being chamfered at an angle of 45°;

a driven guider arranged to be movable in an axial direction relative the channel and actuated by said drive guider, said driven guider being provided with a roller at one corner thereof and being brought into contact with the chamfered corner of the drive guider at said roller;

two parallel guide shafts integrally extending from the driven guider in the same direction as a moving direction of said driven guider, said guide shafts slidably passing through a fixed guide member, thus being linearly movable along with the driven guider in the axial direction under the guide of said fixed guide member;

an air cylinder fixed to said two guide shafts at a position opposite to the driven guider, said air cylinder being normally biased toward the fixed guide member;

a retractable connection rod extending from said air cylinder in a direction toward the outlet of the channel and actuated by the air cylinder so as to selectively reach the outlet of the channel when being fully extended; and a centering stopper fixed to an outside end of said connection rod and adapted for stopping each of the conveyed buttons at the outlet of the channel while centering each of the buttons.

5. The device according to claim 1, wherein said rotatable feeding unit comprises:

a shafted arm arranged to be rotatable around a shaft at an angle, thus selectively reaching the outlet of the channel or the sewing position, said arm being provided with a button holder at its free end for retaining the centered position of the buttons while moving each of the centered buttons from the outlet of the channel to the sewing position.

* * * * *